US005620176A

United States Patent [19]

Spoorenberg et al.

[11] Patent Number: 5,620,176

[45] Date of Patent: Apr. 15, 1997

[54] SHEET DISCHARGING APPARATUS

[75] Inventors: Christophorus L. Spoorenberg, Nuenen; Petrus J. M. Thissen, Heythuysen, both of Netherlands

[73] Assignee: OCÉ-Nederland, B.V., Venlo, Netherlands

[21] Appl. No.: 400,810

[22] Filed: Mar. 8, 1995

[30] Foreign Application Priority Data

Mar. 14, 1994 [NL] Netherlands ..... 9400396

[51] Int. Cl.[6] ..... B65H 3/14

[52] U.S. Cl. ..... 271/98; 271/96; 271/99; 271/104

[58] Field of Search ..... 271/98, 99, 104, 271/108, 94, 96, 161

[56] References Cited

U.S. PATENT DOCUMENTS

| | | | |
|---|---|---|---|
| 3,226,107 | 12/1965 | Staines . | |
| 4,336,929 | 6/1982 | Hanzlik | 271/99 |
| 4,411,417 | 10/1983 | Browne | 271/98 |
| 4,579,330 | 4/1986 | Lehmann . | |
| 4,662,622 | 5/1987 | Wimmer et al. | 271/98 |
| 5,050,853 | 9/1991 | Lavos et al. | 271/98 |
| 5,098,077 | 3/1992 | Russel | 271/98 |
| 5,181,711 | 1/1993 | Spoorenberg | 271/98 |

FOREIGN PATENT DOCUMENTS

| | | | |
|---|---|---|---|
| 104878 | 4/1984 | European Pat. Off. | 271/99 |
| 5-319601 | 3/1993 | Japan | 271/98 |
| 8900754 | 10/1990 | Netherlands . | |

*Primary Examiner*—Karen B. Merritt
*Assistant Examiner*—Douglas Hess
*Attorney, Agent, or Firm*—Birch, Stewart, Kolasch & Birch, LLP

[57] ABSTRACT

A device whereby sheets can be discharged one by one from the bottom of a stack of sheets provided in a holder having a base support and side supports wherein in the transverse direction of sheet transport the base support surface has a downward bent shape so that the support surface has a deepened part on its supporting side such that in the proximity of the deepened part, beneath at least an edge zone of one side of a stack of sheets to be accommodated, the support surface is provided with at least one opening in which a vacuum can be created so that the bottom sheet is sucked against the support and air is blown against the side of the stack as considered with respect to the direction of sheet transport, in order to create an air layer at least between the bottom sheet and the stack thereabove, the airflow being ejected in the proximity of the deepened part of the support surface.

12 Claims, 8 Drawing Sheets

SHEET DISCHARGING APPARATUS

BACKGROUND OF THE INVENTION

1. Field of the Invention

The present invention relates to a sheet discharging apparatus and, more specifically, to a device for discharging sheets one by one from the bottom of a stack of sheets.

2. Discussion of Related Art

A device of this kind, in which the support surface for a stack of sheets has a downward bent shape transverse to the direction of sheet transport, is known from U.S. Pat. No. 5,050,853. In this known device, since air is blown to the side of the stack in the vicinity of the deepened part of the support, while at the same time the bottom sheet is sucked against the support, an air layer forms between the sheet and the stack thereabove and the stack is lifted from the bottom sheet, so that the friction between the bottom sheet and the rest of the stack is reduced. The bottom sheet can be transported as a result. Although a reasonably good separation of the bottom sheet from the rest of the stack is achieved with this device, generally it has been found in practice that separation and transport may be disturbed if the stacks of sheets used have very different stack weights and stack heights, if sheets with different degrees of stiffness are used, and with sheets which are very curled or have deformations, for example due to stapling or perforation.

SUMMARY OF THE INVENTION

Therefore, it is an object of the present invention to provide a sheet discharging device which overcomes the above noted disadvantages.

It is a further object of the present invention to provide an apparatus for discharging sheets in a reliable manner one by one from the bottom of a stack of sheets.

The foregoing objects and others are accomplished in accordance with the present invention, generally speaking, by providing a sheet discharge device comprising a holder provided with a support surface for a stack of sheets, the support surface being provided with one or more openings in which a first vacuum can be created by suction means in order to suck the bottom sheet against the support surface, a means for blowing air over the support surface at least against one side of the stack with respect to the direction of transport of the sheets, in order to create an air layer at least between the bottom sheet and the stack thereabove, and also transport means for discharging the bottom sheet. Pursuant to the discharge of the bottom sheet from the support surface with the one or more openings, a second higher vacuum is temporarily created in one or more of the openings in order to bring the next sheet to the support surface. In this way, the separation of the following sheet from the stack thereabove is accelerated and made more reliable. The separation of this sheet from the stack thereabove is favorably influenced by increasing the vacuum in the one or more openings during or after, preferably directly after, the discharge from the openings in the support surface of the bottom sheet. As a result, the air layer present beneath the stack thereabove is efficiently sucked away so that the next sheet can fall quickly and reliably towards the support surface.

In a further embodiment of the instant invention, wherein the transport means comprises one or more openings connected to a suction means, in which a vacuum can be created in one or more of the openings in order to suck the bottom sheet for discharge against at least a part of the transport means, means are provided for reducing the vacuum in the at least one opening in the transport means during the discharge of the sheet therefrom. As a result, the next sheet is prevented from being entrained by the transport means during the transport of the bottom sheet.

In another embodiment, means are provided whereby, during the temporary increase of the vacuum in the one or more openings of the support surface, the amount of air blown over the support surface against the at least one side of the stack is temporarily reduced in order to create an air layer at least between the bottom sheet and the stack thereabove. As a result, the amount of air between the moving bottom sheet and the stack thereabove is reduced, so that the stack thereabove can fall towards the support surface quickly, with little or no obstruction from laterally injected air.

One embodiment of the device according to the invention is characterized in that the suction means to which the one or more openings of the support surface are connected and the suction means to which the one or more openings in the transport means are connected comprise a common fan, which, in a first position of a multi-position selector valve, is connected via the valve to the one or more openings in the support surface and the one or more openings in the transport means and, in a second position of the selector valve, is connected to the one or more openings in the support surface, the connection between the fan and the at least one opening in the transport means being completely or substantially completely closed, while in the first position the first vacuum is created and in the second position the second vacuum increased, the vacuum in the transport means also being reduced.

In another embodiment, the device is characterized in that the suction means to which the one or more openings of the support surface are connected and the suction means to which the one or more openings in the transport means are connected comprise a common fan which, in a first position of a multi-position selector valve, is connected via the valve to the one or more openings in the support surface and the one or more openings in the transport means and, in a second position of the valve, is connected to the one or more openings in the support surface, the connection to the at least one opening in the transport means being completely or substantially completely closed, while in the first position the first vacuum is created and in the second position the second vacuum increased, the amount of air for blowing against the side of the stack also being reduced.

The use of special selector valves in a device according to the invention makes it possible easily and economically to switch the various pressures reliably has been found very advantageous to use a device wherein the suction means comprise a fan which, in a first position of a first multi-position selector valve, is connected via the valve to the one or more openings in the transport means and wherein in a second position the connection to the one or more openings in the transport means is completely or almost completely closed and the one or more openings in the transport means are open to the surroundings, and which in a first position via a second multi-position selector valve is connected to the one or more openings in the support surface for the creation of the first vacuum and in a second position for the creation of the second vacuum, means provided for bringing the first and the second multi-position selector valves simultaneously or almost simultaneously from their first position to their second position and for bringing the first and second multi-position selector valves simultaneously or almost simultaneously from their second position to their first position. This ensures coordination between the switching times for the various pressures.

Although the support surface in the devices according to the invention can be flat, it has been found in practice that the separation of the sheets from one another is much more reliable in a device in which the support surface has a downward bent shape transversely of the direction of sheet transport, so that the support surface has a deepened part in which the one or more openings (10) are provided.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DISCUSSION OF THE INVENTION

Figure 1:
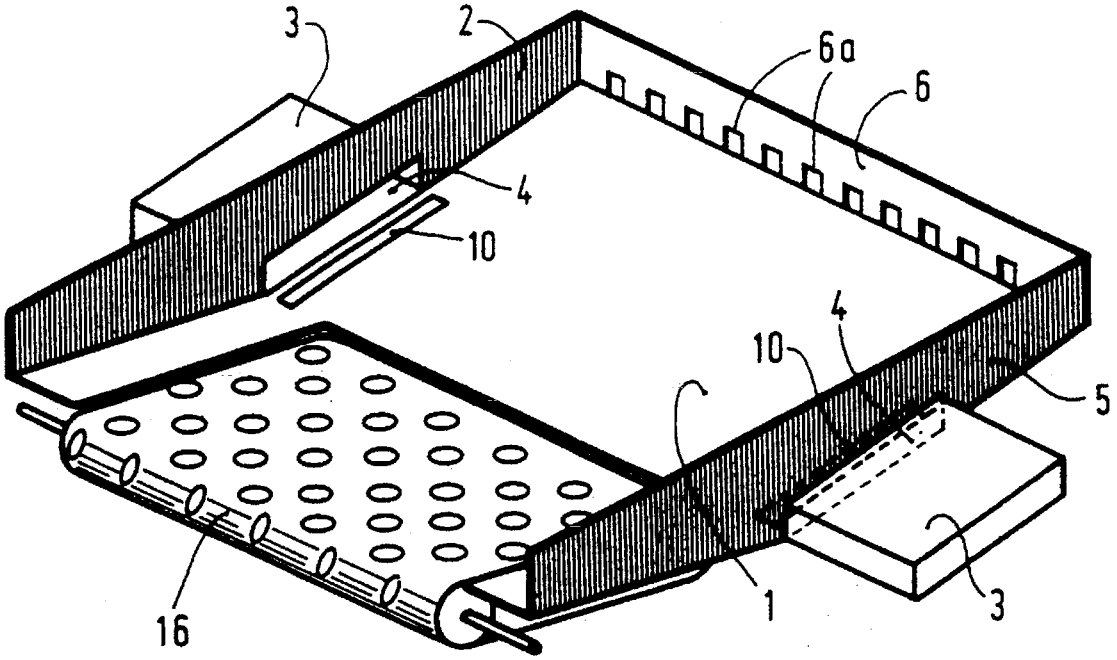
FIG. 1 diagrammatically illustrates one embodiment of the device according to the invention.

The device shown in FIG. 1 comprises a holder for a stack of sheets with a downward bent support 1 and side supports in the form of side walls 2, 5, on which are secured air supply ducts 3, which are connectable to one or more air supply sources (not shown) and which terminate in blast openings 4 in the proximity of the deepened part of the holder, so that the air is blown to the sides of the stack perpendicular to the direction of transport of the sheets and parallel to the support surface.

In the proximity of the blast openings 4, the support surface 1 is provided with openings 10 via which the bottom sheet is sucked towards the support surface 1 at the blast openings 4. The openings 10 are in the form of slots which extend near the zones where air is effectively blown into the stack and are situated in the proximity of the side edges of the sheet so as to prevent air blown in the stack from being blown between the bottom sheet and the support surface 1. The side wall may be provided with a plurality of blast apertures in order to lift the stack. By blowing air into the stack a layer of air forms between the bottom sheet sucked against the support surface and the remainder of the stack. The support surface may be formed in many ways. Some of the possible forms are given in the above-mentioned U.S. Pat. No. 5,050,853, the contents of which are fully included in this application by reference thereto. The deepened part of the support surface 1 on the support side may be provided with one or more elevated parts which extend alone or jointly over the deepened part transverse to the direction of transport, as described in NL-A-9002121, the contents of which is entirely incorporated herein by reference. The openings 6*a* in the back wall 6 serve to discharge the air blown into the stack. It is also possible to use a closed back wall. In fact this is favorable when thick stacks of very curled sheets are used.

Figure 2:
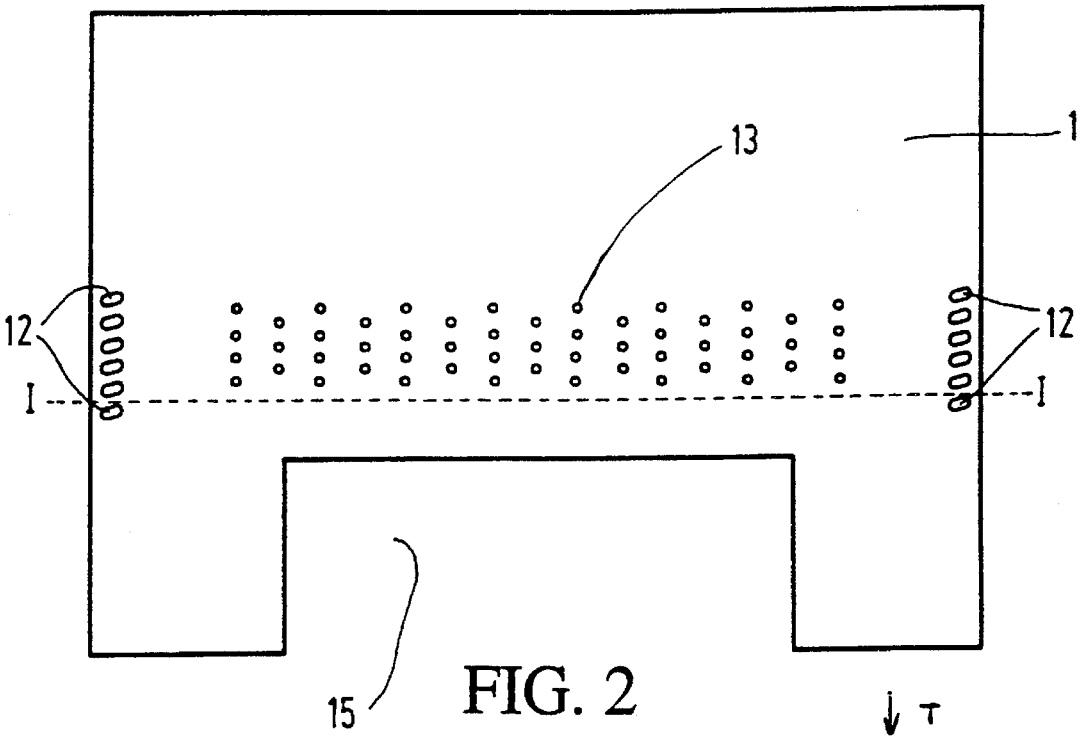
FIG. 2 is a diagrammatic top plan view of another embodiment of the support surface of the discharge device of the present invention.

The embodiment of the support surface 1 shown in FIG. 2 is bent downwards at the place indicated by the line I—I, the angle between the front part of this plate and the back part being about 168°. The support surface is provided with openings 13 in which a vacuum can be created. In other embodiments, openings 13 are provided in the support surface in the neighborhood of an elevated part. The support surface 1 is also provided with a recess 15 for a transport means 16, which serves to discharge the bottom sheet.

Figure 3A:
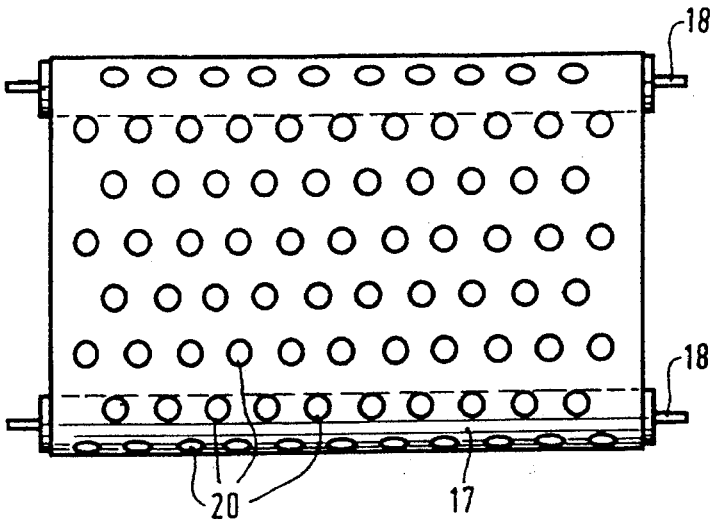
FIG. 3*a* is an embodiment of the transport means usable in the device according to the present invention.
Figure 3B:
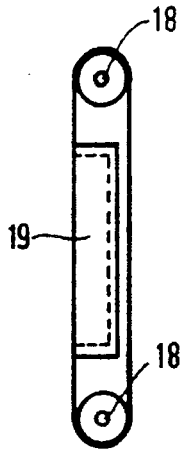
FIG. 3*b* is a cross-section of the transport means of FIG. 3*a*, FIG. 4, A to D, illustrates one embodiment of the selection of the pressures in the various openings, FIG. 5, A to D, illustrates another embodiment of the selection of the pressures in the various openings.
Figure 4A:
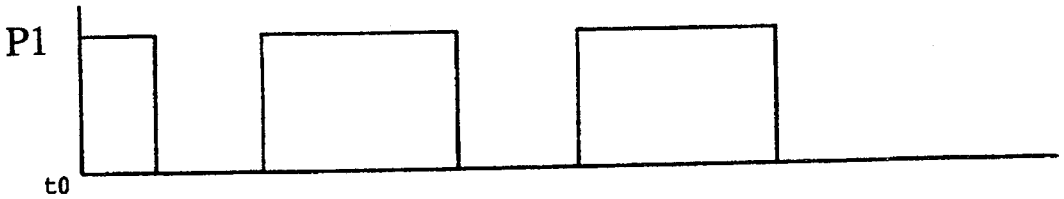
Figure 4B:
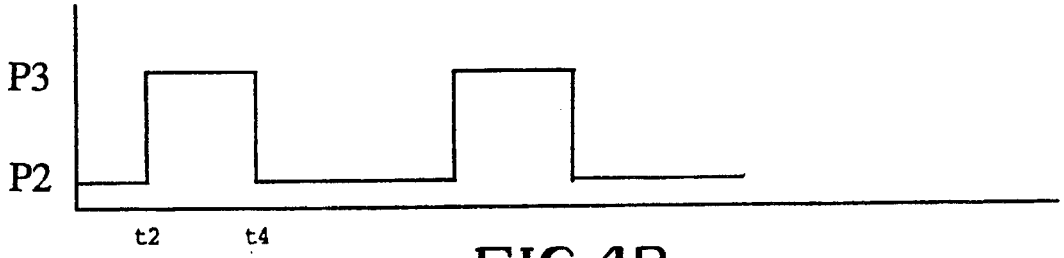
Figure 4C:
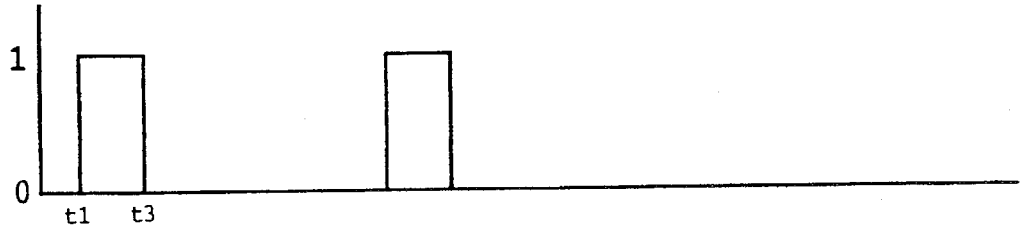
Figure 4D:
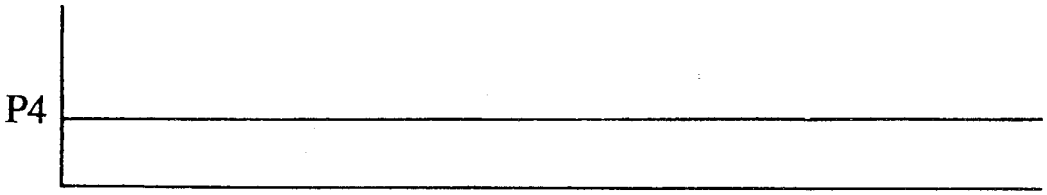
Figure 5A:
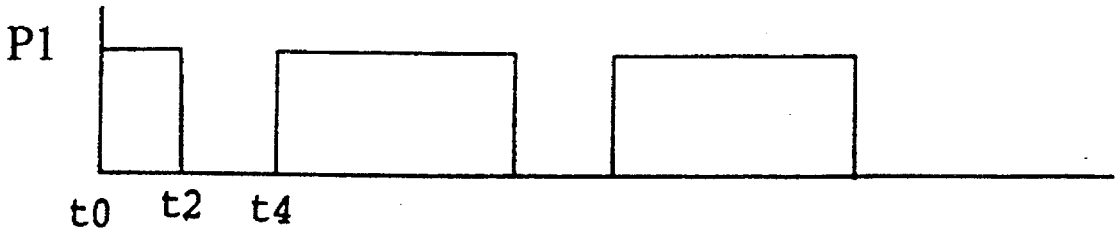
Figure 5B:
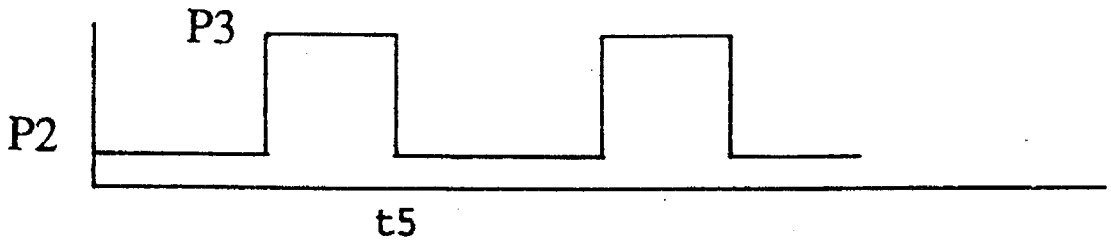
Figure 5C:
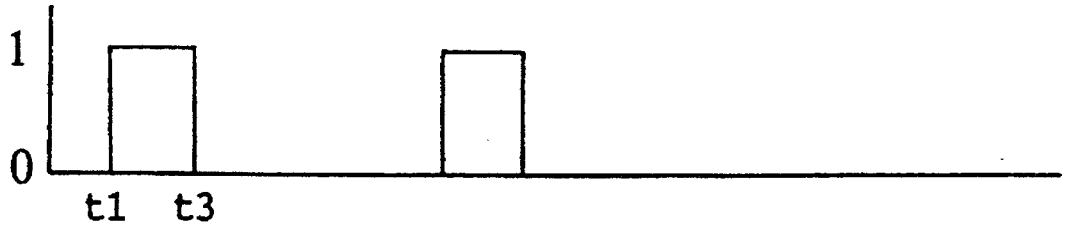
Figure 5D:
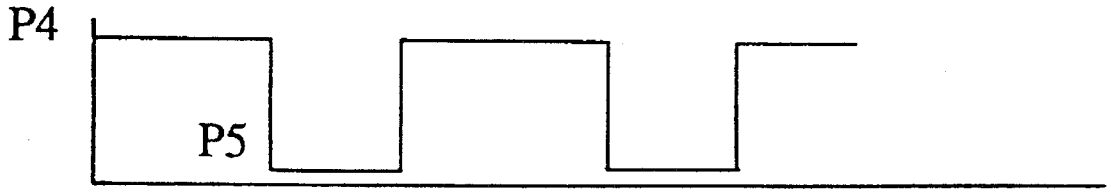

As shown in FIG. 1 and in greater detail in FIGS. 3*a* and 3*b*, the transport means 16 comprises a movable endless rubberized belt 17 provided with openings 20 in which a vacuum can be created. The rubberized belt 17 runs over two rollers 18 and over a suction box, within which the periphery of the belt 17 is located, as will be seen in FIG. 3*b*. The suction box is connected to a vacuum device (not shown), such as a fan, by means of which a negative pressure can be created in the openings 20.

To be able to discharge the bottom sheet, the belt 17 must exert a force on the bottom sheet such that the friction of the sheet against the support surface 1, on the one hand, and the sheet directly thereabove, on the other hand, is overcome. The force exerted by the belt 17 on the bottom sheet depends, inter alia, on the coefficient of friction between the belt 17 and the sheet for transportation, the vacuum in the suction box 19 and the effective suction area. The latter is the effective area where the vacuum is located and depends, inter alia, on the roughness of the belt 17 and of the sheet for transportation, the size of the openings 20, and the hole pattern in the belt 17 and the size of the suction box 19 beneath the belt 17. Instead of the transport means 16, it is possible to use other transport means known for this purpose. For example, use may be made of a friction roller or a suction roller as known from U.S. Pat. No. 4,579,330, but because of its greater effective suction area the transport means 16 shown in FIG. 1 is preferred.

The side supports need not consist of side walls extending along the entire side of the stack, as shown in FIGS. 1 and 2, but may, inter alia, be in the form of side stops against a part of the stack or in the form of locating pins, one or more air feed ducts being disposed near that part where the support is deepest, the ducts terminating in blast openings directed towards the stack. There is no need for the side supports to adjoin the stack directly. The means for blowing the air against the side of the stack may also be positioned on just one side. In order to avoid static charges, the support surface may be made from an antistatic plastic or be provided with a conductive coating. By making one or two side supports movable, the device can within certain limits be used to discharge sheets of different formats. For this purpose the back wall can also be movable.

The device can be used in an electrophotographic copying machine in order to discharge a set of documents sheet by sheet several times to the exposure window of the machine, the sheets being reproduced and then re-deposited in the holder. In such cases it is desirable that in order to promote good positioning of the sheets to be deposited on the stack and good separation of the sheets, the holder should be so disposed in the transport direction so that the front edge of the support surface 1 is higher than the back edge.

The operation of the device of the present invention is as follows. By the creation of a vacuum in the openings 10, 12, and 13 in the support surface 1 and in the openings 20 in the transport belt 17 and by the blowing of air against the side of the stack in the proximity of the deepened part of the support surface 1, the bottom sheet is sucked against the support surface and the stack thereabove is lifted by the air blown against the side of the stack and a layer of air or air chamber forms between the sheet and the stack thereabove since, as a result of the dead weight of the stack, the front and back of the stack operate as a seal. The pressure exerted by the air in this layer causes the stack situated above the bottom sheet to be lifted from the latter so that the friction between the bottom sheet and the rest of the stack is reduced. One or more elevated parts extending over the support, if they are provided, give the bottom sheet a deformation in these conditions, and the stack thereabove is less capable of following this deformation because of its greater rigidity. By blowing air against the side at the location of the deformation the stack thereabove is reliably separated from the sheet therebeneath. The size and shape of the space formed during blowing between the bottom sheet and the rest of the stack is influenced, inter alia, by the shape of the support surface, the place where the air is blown in, the number of blast openings 4 in the side walls 2 and 5, the shape of the blast openings 4, the direction in which the air is blown, the amount of air blown into the stack, the air velocity, and the presence of leakage openings through which air can escape from the stack.

Depending on the construction of the device, the skilled artisan can readily experiment to find the required combination of air velocity, amount of air blown in and blowing direction, for good separation. When the air layer forms between the bottom sheet and the stack thereabove the bottom sheet is discharged by means of the conveyor device 16. In such cases it is particularly favorable to withdraw the bottom sheet from beneath the stack at a high acceleration. The sheet situated directly above the bottom sheet then remains behind as a result of mass inertia. Good results can be obtained with an acceleration of about 30 $m/s^2$ and upwards.

When use is made of the support surface 1 provided with openings 10 in the deepened part, in which a vacuum can be created, as shown in FIG. 1, the air present between the sheet and the stack thereabove during or after the withdrawal of the bottom sheet from the openings 10 can be discharged at an accelerated rate by temporarily increasing the vacuum in the openings 10 so that the sheet directly above the sheet is conveyed rapidly to the support surface 1, whereafter the sheet is sucked against the support surface at the location of the openings 10 in which an increased vacuum is present.

When use is made of a support surface 1 provided with openings 12 and 13 in the deepened part, in which a vacuum can be created, as shown in FIG. 2, the air present between the sheet and the stack thereabove during or after the withdrawal of the bottom sheet from the openings 12 and 13 can be discharged at an accelerated rate by temporarily increasing the vacuum in the openings 12 and/or 13 so that the sheet directly above the sheet is conveyed rapidly to the support surface 1, whereafter the sheet is rapidly sucked against the support surface 1.

FIG. 4 diagrammatically illustrates one embodiment of the progress of the discharge cycle against time. Diagram A of this Figure shows the pressure against time in the openings 20 of transport belt 16. Diagram B of this Figure shows the pressure against time in the openings 12, 13 of support surface 1. Diagram C of this Figure shows the transport belt rendered operative and inoperative against time. Diagram D of this Figure shows the pressure against time in the blast openings 4.

At the time t0 the vacuum in the openings 20 in the transport belt 16 is set to pressure P1 (diagram A). At the same time, the vacuum in the openings 12 and 13 in the support surface is set to pressure P2 (diagram B) and the blast pressure in the blast nozzles 4 is set to P4 (diagram D). With these adjustments, the bottom sheet is sucked against the support surface 1 and a layer of air is built up between the bottom sheet and the stack thereabove. At time t1 the transport means is started to discharge the bottom sheet (diagram C). At time t2 the sheet is clear of the openings 12 and 13. The pressure in the openings 12 and 13 is then increased to vacuum P3, so that the layer of air is discharged at an accelerated rate. At the same time, the openings 20 in the transport belt are brought to atmospheric pressure. This obviates any double sheet discharge. At time t3 the sheet has left the transport means and the movement of the transport means is stopped. At time t4, when the next sheet is sucked against the support surface, the starting condition is restored. The vacuum in the openings in the transport means is returned to P1 while the vacuum in the openings 12 and 13 is set to pressure P2. The discharge cycle can then be repeated. The blast pressure P4 is kept constant during the whole cycle.

FIG. 5 diagrammatically shows a different embodiment of the progress of the discharge cycle against time. Diagram A of this Figure shows the pressure against time in the openings 20 of transport belt 16. Diagram B of this Figure shows the pressure against time in the openings 12, 13 of support surface 1. Diagram C of this Figure shows the transport belt being rendered operative and inoperative against time. Diagram D of this Figure shows the pressure against time in the blast openings 4.

At the time to the vacuum in the openings 20 in the transport belt 16 is set to pressure P1 (diagram A). At the same time, the vacuum in the openings 13 in the support surface is set to pressure P2 (diagram B) and the blast pressure in the blast nozzles 4 is set to P4 (diagram D). With these adjustments, the bottom sheet is sucked against the support surface 1 and a layer of air is built up between the bottom sheet and the stack thereabove. At time t1 the transport means is started to discharge the bottom sheet (diagram C). At time t2 the openings 20 in the transport belt are brought to atmospheric pressure. This obviates any double sheet discharge. At time t3 the sheet has left the transport means and the movement of the transport means is stopped. At time t4 the pressure in the openings 12 and 13 is increased to vacuum P3 so that the layer of air is discharged at an accelerated rate. At the same time the blast pressure is reduced to pressure PS.

When the next sheet has been sucked against the support surface (time t5) the starting condition is restored. The vacuum in the openings in the transport means is again set to P1 while the vacuum in the openings 13 is set to pressure P2. The blast pressure is returned to pressure P4.

Figure 6:
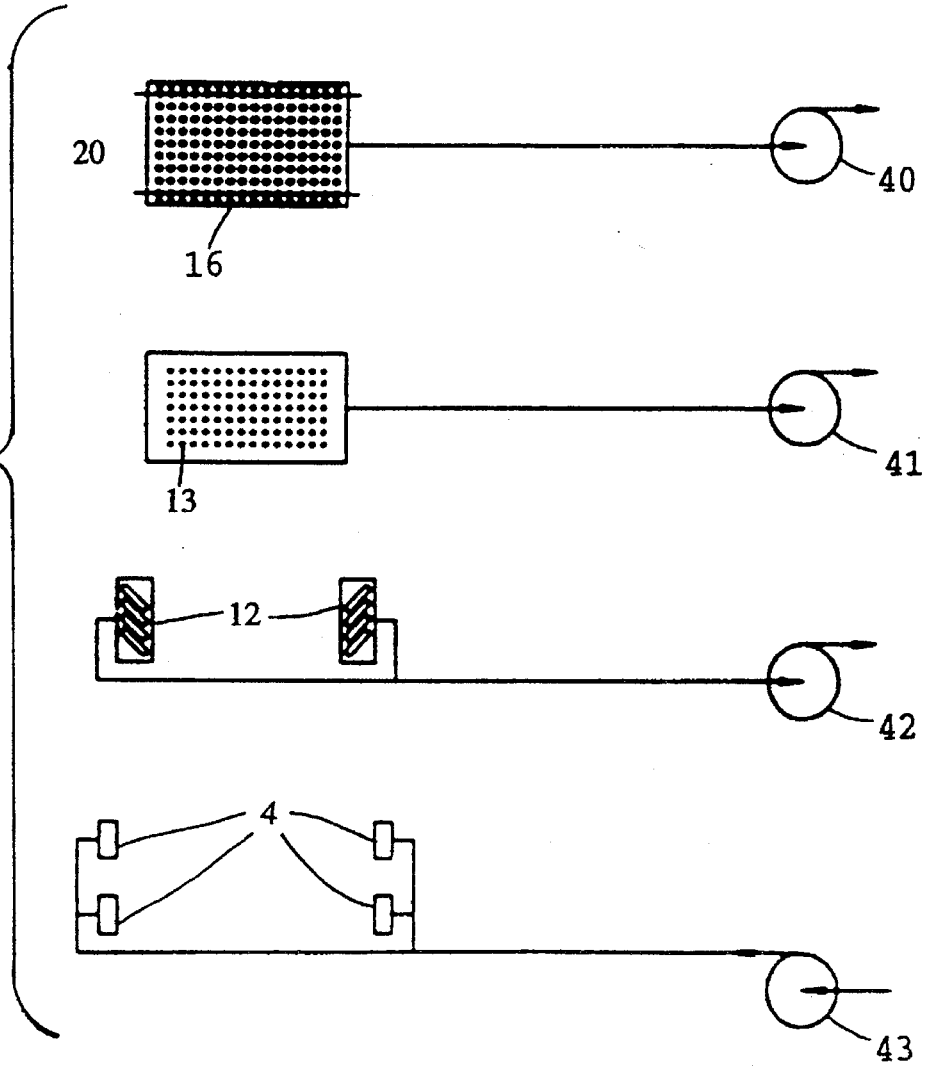
FIG. 6 is a diagram showing the connection of the various openings in one embodiment of the device according to the present invention.

It takes some time before a new layer of air forms between the next sheet sucked against the support surface and the stack thereabove and the next sheet can be transported. This time depends, inter alia, on the amount of air injected, the air velocity and the stiffness of the sheets. The discharge cycle can then be repeated. In the embodiment as shown in FIG. 1, modified with a support surface as shown in FIG. 2, one or more of each of the openings 4, 12, 13 and 20 may be connected to separate fans as shown in the diagrammatic connection plan of FIG. 6. The openings 20 are connected via conduits to fan 40 and the openings 12 are connected via conduits to fan 41. The openings 13 are connected via conduits to fan 42 and the openings 4 are connected via conduits to fan 43.

The required pressures can be set in a known manner, e.g. by fan selection, the use of restrictions and/or controlled leakage. It will be apparent to the skilled man that it is also possible to use one, two or three fans instead of four. A fan is then connected to different groups of openings, the pressures being adjustable, for example, by means of the above steps. The temporary vacuum increase can be obtained in various ways. For example, the fan speed can be increased, any connection to the surroundings can be shut off by means of a valve, and so forth.

Figure 7:
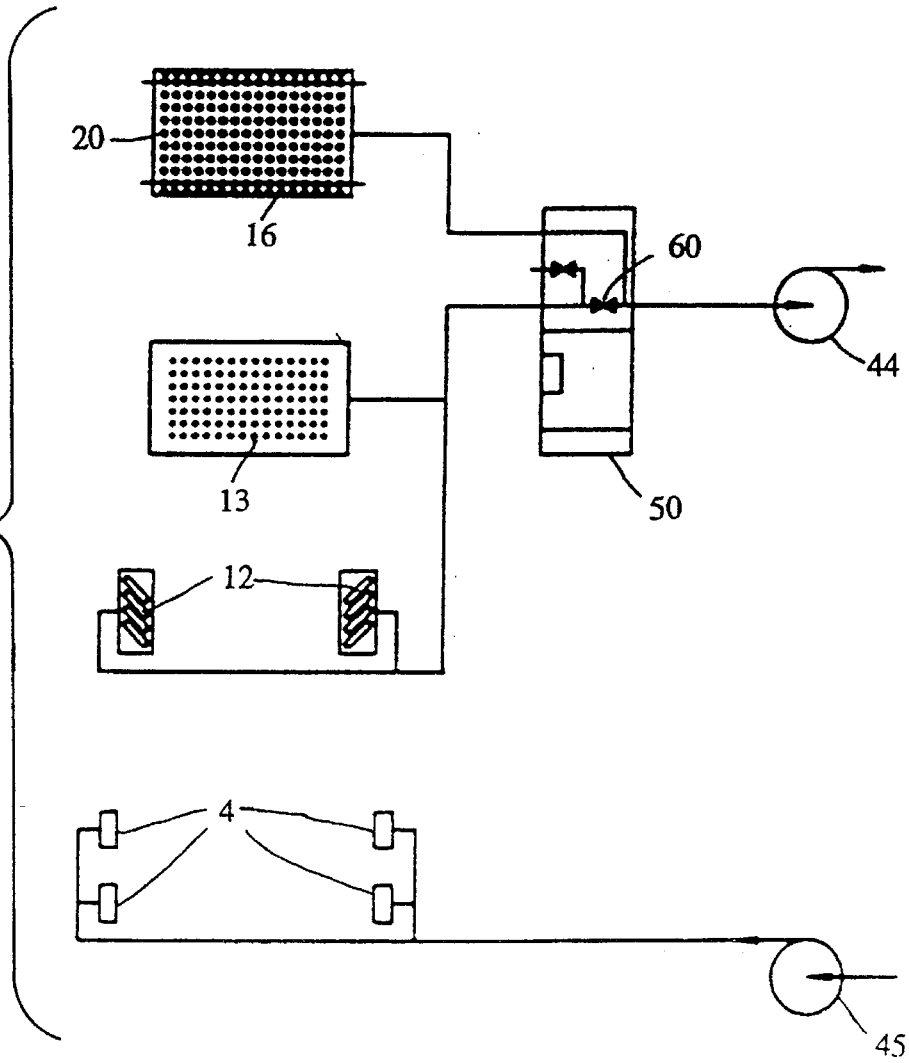
FIG. 7 is a diagram showing the connection of the various openings in another embodiment of the device according to the present invention, with a multi-position selector valve in a first position.
Figure 8:
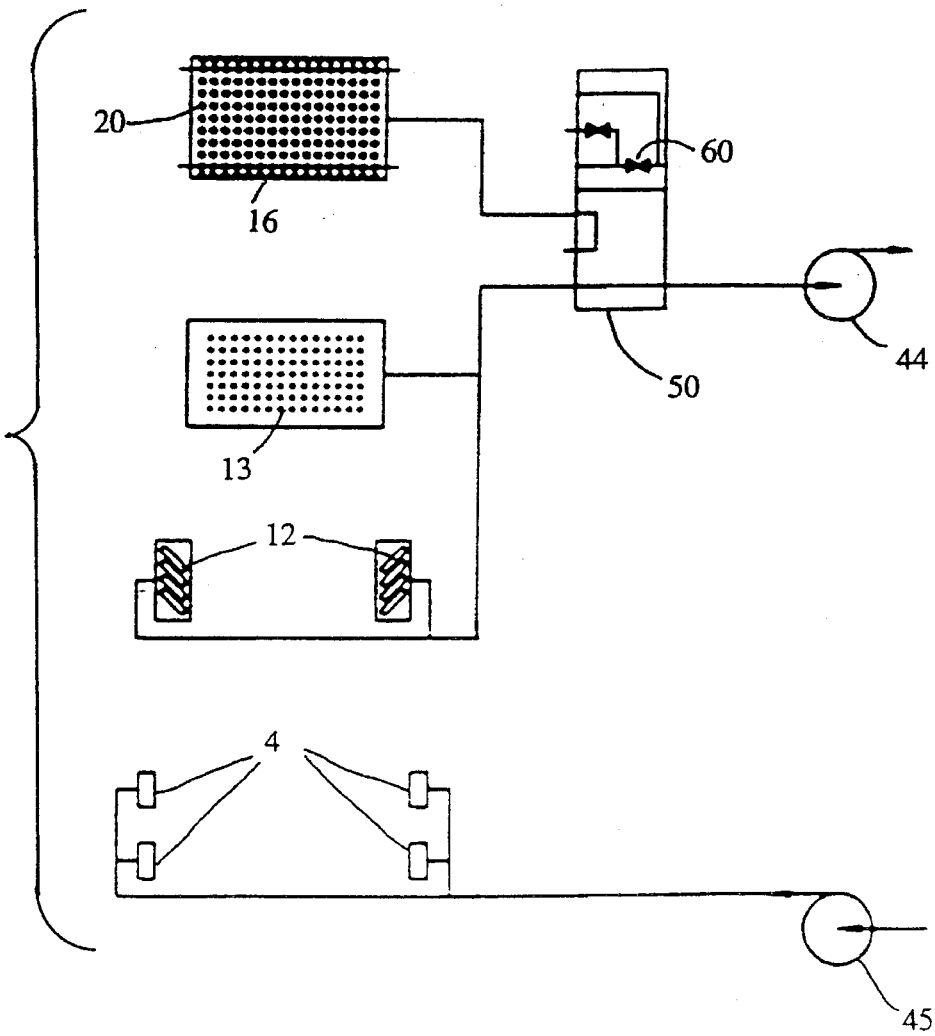
FIG. 8 is a diagram showing the connection of the various openings in the embodiment shown in FIG. 7, with the multi-position selector valve in a second position.

In the embodiment with the connection diagram shown in FIG. 7, the openings 12, 13 and 20 are jointly connected to a fan 44 via a multi-position selector valve 50. As known to the skilled man, the various negative pressures can be set via the diameter of the various connecting conduits. In FIG. 7, the multi-position selector valve 50 is shown in a first position in which the openings 12 and 13 are connected to the fan via a restrictor 60, while the openings 20 in the transport belt are connected directly to the fan.

In FIG. 7, the connection diagram of this same embodiment is shown with the multi-position selector valve in a second position in which the openings 20 in the transport belt are connected directly to atmosphere, so that the vacuum is cancelled, the openings 12 and 13 being connected directly to the fan.

The blast openings 4 are connected to fan 45, which can be kept at a constant blast pressure during the complete cycle but can also be so constructed as to be set to different blast pressures. Thus the blast pressure can be reduced simultaneously or practically simultaneously with the increase of the vacuum in the openings 12, 13.

Figure 9A:
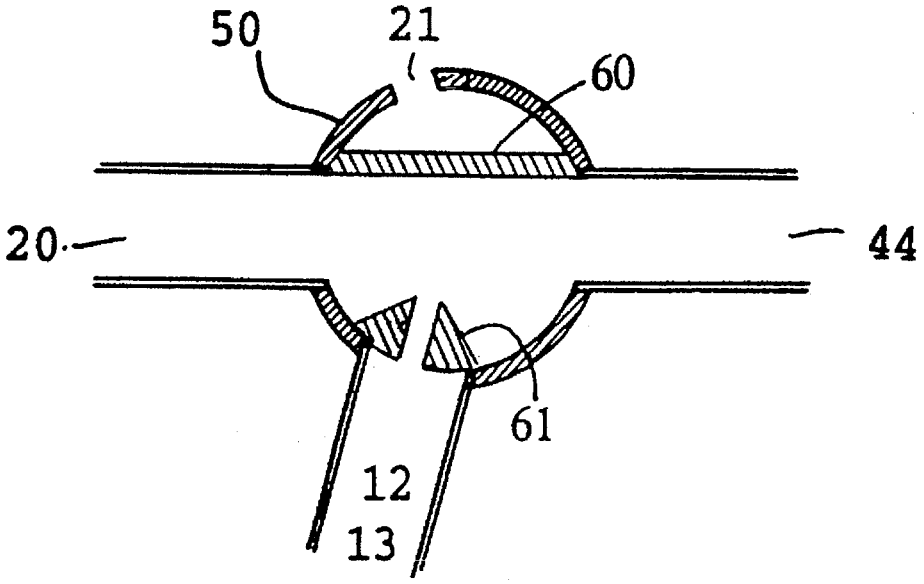
FIG. 9*a* is a cross-section of a multi-position selector valve usable according to the invention in a first selection position.
Figure 9B:
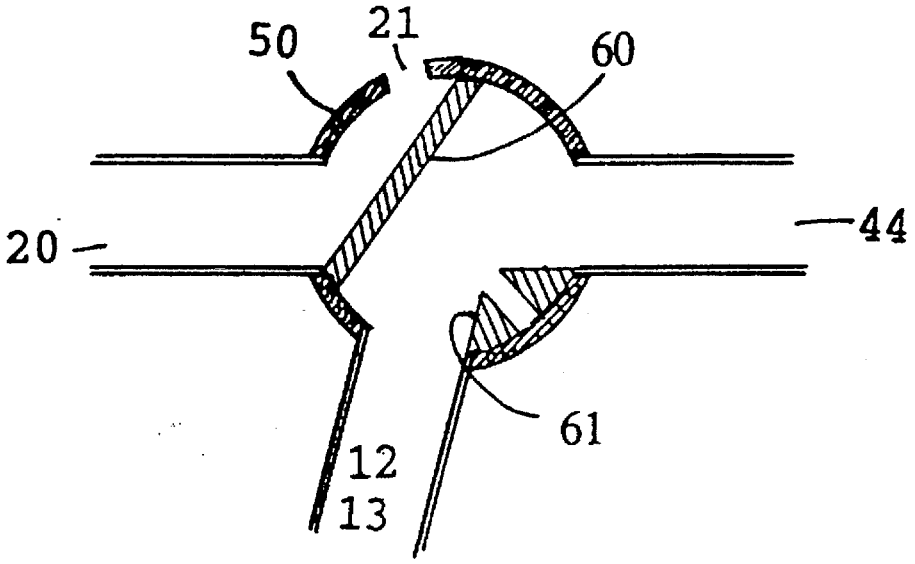
FIG. 9*b* is a cross-section of the multi-position selector valve according to FIG. 9*b* in a second selection position.

Variants of this embodiment are, for example, devices in which either the openings 12 or the openings 13 are connected together with the openings 20 to a fan via the common selector valve, while either the openings 13 or the openings 12 are connected to a separate fan. In a variant of this kind it is possible, for example, to eliminate the vacuum in the openings 12 or 13 separately during the transport of the bottom sheet over the openings 12 in order to reduce during transport the counter force exerted on and holding the sheet. These openings 12 or 13 can also be connected to atmospheric pressure during the processing of thin sets of originals (e.g. sets with less than four originals) when the device is used in an electrophotographic copying machine in order to discharge one set of documents sheet by sheet several times to the exposure window of the machine, whereafter the sheets are copied and then returned to the holder. This prevents a sheet which is to be returned to the empty holder from being sucked too rapidly against the support surface so that the falling sheet is sucked obliquely or with creases against the support surface. The multi-position selector valve may be an ordinary rotating valve 50, as shown in FIG. 9*a*, in which the valve member 60 is shown in its first position in which the fan 44 is connected to the openings 20 and via a restrictor 61 to the openings 12 and 13, while in FIG. 9*b* the valve member is shown in the second position in which the openings 20 are directly connected to atmosphere and the openings 12 and 13 are directly connected to the fan.

Figure 10A:
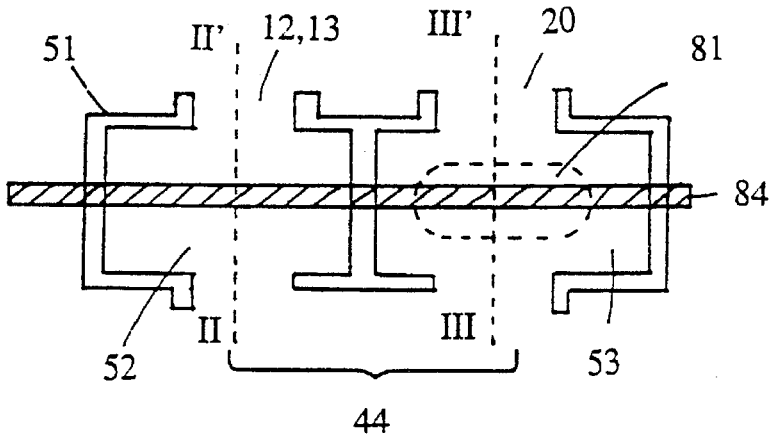
FIGS. 10*a* to 10*e* are cross-sections of a double multi-position selector valve in various selection positions.
Figure 10B:
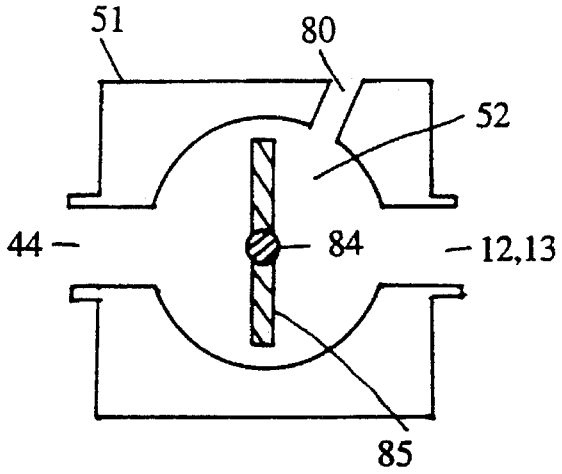
Figure 10C:
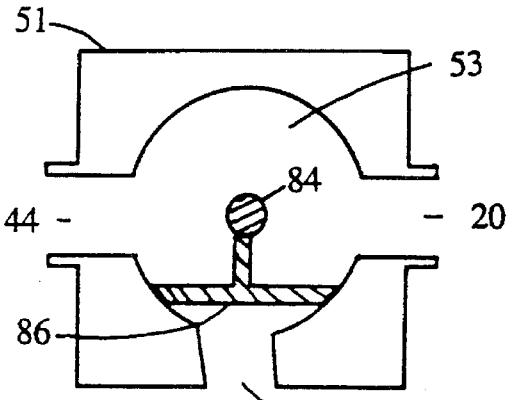

FIG. 10*a* shows a particularly suitable selector valve 51 combining two multi-position valves. The housing comprises two chambers 52 and 53 with a rotary valve member in each chamber, as shown in the cross-sections on the lines II—II' and III—III' in FIGS. 10*a* and 10*b*. Both chambers are connectable to the common fan 44 and are separately connected to openings 20 and openings 12 and 13. The valve members are secured on a common rotatable spindle 84. On one side, chamber 52 has an opening which can be connected to fan 44 and on the other side an opening which can be connected to the openings 12 and/or 13. By setting the rotary valve member 85 to a first position, as shown in FIG. 10*b*, actuation of fan 44 creates a first vacuum in the openings 12 and 13. Opening 80 is optional. It is provided to prevent an excessive increase of the vacuum in the openings 12 and 13 in the support surface 1 when a sheet is situated thereon, through the openings 12 and 13 being completely closed. At the same time, the valve member 86 is so disposed in chamber 53 that the connection between the fan 44 and the openings in the transport belt 20 is fully open and the opening to the surroundings 81 is closed (FIG. 10*c*).

Figure 10D:
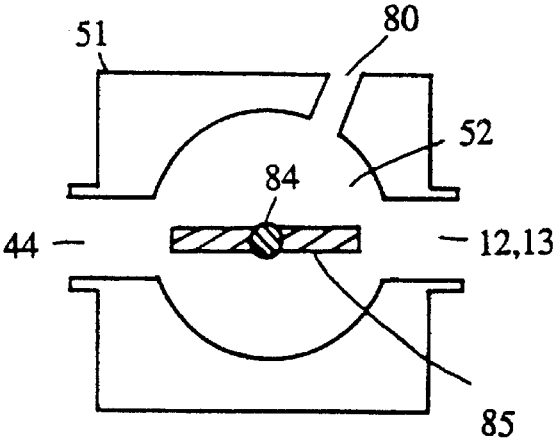
Figure 10E:
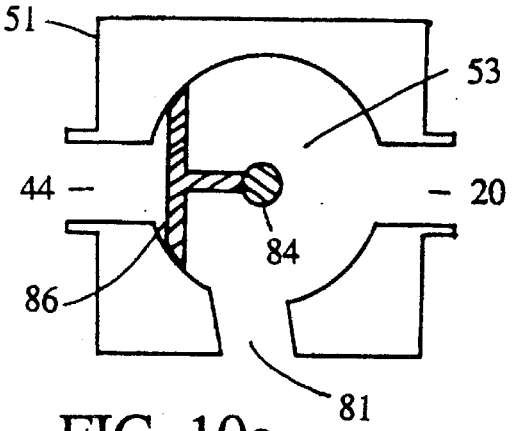

In FIGS. 10*d* and 10*e* the chambers 52 and 53 are shown with the valve members in their second position. The changeover from the first position to the second position is a simple matter by rotation of the valve members about the common axis 84. In the second position, the valve member is so disposed in the chamber that the openings 12 and 13 are directly connected to the fan.

The valve member is also so disposed in the chamber that the openings 20 are connected directly to atmosphere via opening 86 and the opening to the fan 44 is closed. This valve is particularly suitable for use in the device according to the invention by automation of the selection process in order to achieve the negative pressures in the various openings 12, 13, 20 simply by rapid rotation of the spindle 84.

The device can be controlled by means of a program preset, for example, in a memory chip, the times of the various steps in the discharge cycle being fixed. Also, one or more sensors may be provided, for example to control the discharge cycle in dependence on the position of the sheet for discharge.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A sheet discharging device for discharging sheets one by one from the bottom of a stack of sheets, comprising:

a holder provided with a support surface for a stack of sheets, said support surface being provided with one or more openings in which a first vacuum can be created by suction means so as to suck a bottom sheet against said support surface, means for blowing air over said support surface at least against one side of said stack perpendicular to the direction of the transport of said sheets, in order to create an air layer at least between said bottom sheet and that stack of sheets thereabove, transport means for discharging said bottom sheet, and means whereby, in dependence on the discharge of said bottom sheet from said one or more openings, a second higher vacuum is temporarily created in said one or more openings in order to bring the next sheet to the support surface.

2. The device according to claim 1, wherein said second higher vacuum in said one or more openings is temporarily created during discharge of said bottom sheet.

3. The device according to claim 1, wherein said second higher vacuum in said one or more openings is temporarily created after discharge of said bottom sheet.

4. The device according to claims 1, 2 or 3, wherein said transport means comprises one or more openings connected to suction means, a vacuum is created in said one or more openings in order to suck said bottom sheet for discharge against at least a part of said transport means, further including means for reducing said vacuum in said at least one opening in said transport means during discharge of a sheet therefrom.

5. The device according to claims 1, 2 or 3, further including means whereby, during a temporary creation of said second, higher vacuum in said one or more openings of said support surface, the amount of air blown over said support surface against at least one side of said stack, in order to create an air layer at least between said bottom sheet and the stack of sheets thereabove, is temporarily reduced.

6. The device according to claim 4, further including means whereby, during a temporary creation of said second, higher vacuum in said one or more openings of said support surface, the amount of air blown over said support surface against at least one side of said stack, in order to create an air layer at least between said bottom sheet and the stack of sheets thereabove, is temporarily reduced.

7. The device according to claim 4, further including a multi-position selector valve, and wherein said suction means to which said one or more openings of said support surface are connected and said suction means to which said one or more openings in said transport means are connected comprises a common fan which, in a first position of said multi-position selector valve, is connected via said valve to said one or more openings in said support surface and said one or more openings in said transport means and, in a second position of said multi-position selector valve, is connected to said one or more openings in said support surface, the connection between said fan and said at least one opening in said transport means being substantially closed, while in said first position of said multi-position selector valve said first vacuum is created and in said second position of said multi-position selector valve said second increased vacuum is created, while said vacuum in said transport means is being reduced.

8. The device according to claim 5, further including a multi-position selector valve, and wherein said suction means to which said one or more openings of said support surface are connected and said suction means to which said one or more openings in said transport means are connected comprises a common fan which, in a first position of said multi-position selector valve, is connected via said multi-position selector valve to said one or more openings in said support surface and said one or more openings in said transport means and, in a second position of said multi-position selector valve, is connected to said one or more openings in said support surface, said connection to said at least one opening in said transport means being substantially closed, while in the first position said first vacuum is created and in said second position said second increased vacuum is created, while the amount of air for blowing against the side of said stack of sheets is being reduced.

9. The device according to claim 6, further including a multi-position selector valve, and wherein said suction means to which said one or more openings of said support surface are connected and said suction means to which said one or more openings in said transport means are connected comprises a common fan which, in a first position of said multi-position selector valve, is connected via said multi-position selector valve to said one or more openings in said support surface and said one or more openings in said transport means and, in a second position of said multi-position selector valve, is connected to said one or more openings in said support surface, said connection to said at least one opening in said transport means being substantially closed, while in the first position said first vacuum is created and in said second position said second increased vacuum is created, while the amount of air for blowing against the side of said stack of sheets is being reduced.

10. The device according to claims 2 or 3, further including a plurality of multi-position selector valves, wherein said suction means comprises a fan which, in a first position of a first multi-position selector valve, is connected via said first selector valve to said one or more openings in said transport means and wherein in a second position the connection to said one or more openings in said transport means is substantially closed and said one or more openings in said transport means are in open connection with the surroundings, and which in a first position via a second multi-position selector valve is connected to said one or more openings in said support surface for the creation of said first vacuum and in a second position for the creation of said second vacuum, and means provided for bringing said first and second multi-position selector valves substantially simultaneously from their first positions to their second positions and for bringing said first and second multi-position selector valves substantially simultaneously from their second positions to their first positions.

11. The device according to claim 1, wherein said support surface has a downward bent shape transverse to the direction of sheet transport, so that said support surface has a deepened part, in which deepened part said one or more openings thereof are provided.

12. The device according to claim 4, further including a plurality of multi-position selector valves, wherein said suction means comprises a fan which, in a first position of a first multi-position selector valve, is connected via said first selector valve to said one or more openings in said transport means and wherein in a second position the connection to said one or more openings in said transport means is substantially closed and said one or more openings in said transport means are in open connection with the surroundings, and which in a first position via a second multi-position selector valve is connected to said one or more openings in said support surface for the creation of said first vacuum and in a second position for the creation of said second vacuum, and means provided for bringing said first and second multi-position selector valves substantially simultaneously from their first positions to their second positions and for bringing said first and second multi-position selector valves substantially simultaneously from their second positions to their first positions.

* * * * *